United States Patent [19]

Nowacki et al.

[11] Patent Number: 4,706,960

[45] Date of Patent: Nov. 17, 1987

[54] FIELDS OF LAW AND LEGAL PROCESS CARD AND BOARD GAME APPARATUS

[76] Inventors: Robert S. Nowacki; K. Kristine Nowacki, both of 429 Tallow Tree Dr., Pensacola, Fla. 32506

[21] Appl. No.: 798,859

[22] Filed: Nov. 18, 1985

[51] Int. Cl.[4] ..... A63F 3/00

[52] U.S. Cl. ..... 273/257; 273/148 A; 273/148 R

[58] Field of Search ..... 273/279, 257, 248, 249, 273/293, 294, 295, 305, 148 R, 148 A, 150; 209/608

[56] References Cited

U.S. PATENT DOCUMENTS

| | | | |
|---|---|---|---|
| 800,486 | 9/1905 | Riblet | 209/608 |
| 2,852,260 | 9/1958 | Caffrey | 273/249 |
| 2,873,976 | 2/1959 | Alatorre | 273/293 |
| 3,643,958 | 2/1972 | Sperber . | |
| 3,889,955 | 6/1975 | Welch et al. . | |
| 3,966,211 | 6/1976 | Brown . | |
| 4,012,045 | 3/1977 | Vail . | |
| 4,039,192 | 8/1977 | Magiera . | |
| 4,045,031 | 8/1976 | Lavine . | |
| 4,068,848 | 1/1978 | Lichtman | 273/257 |
| 4,121,823 | 10/1978 | McBride | 273/249 |
| 4,509,922 | 4/1985 | Battle | 273/279 |

OTHER PUBLICATIONS

Games, 1985 Holiday Gift Catalog.

Trivial Pursuit; Selchow & Righter Games Catalog, 1984; p. 16.

Lawyers' Edition Technicality Cards; advertisement from Playthings Magazine; May 1985, p. 80.

*Primary Examiner*—Richard C. Pinkham

*Assistant Examiner*—Matthew L. Schneider

[57] ABSTRACT

A combined card and board game consisting of over 205 fields of law, legal categories, including legal lexicon, legal terminology and legal processes involving quetions and/or statements and responses. The game includes a board which consists of four pluralities of spaces with indicia which relate to indicia on the cards and spinner and represent legalcategories of law utilizing the alphabet and numerals, a plurality of sets of cards consisting of legal knowledge and information, a rectangular card box, a spinner and gamepieces. The game board is comprised of marked spaces and pathways whereby players move gamepieces in attempt to advance to the winner's/Dean's circle by correct response at his respective turn according to applicants' game rules. The game simulates graduation from law school, receiving an L.L.M., and/or passing the bar and provides an educational, entertaining, teaching, testing and competitive game of chance and legal knowledge. The players will learn and become aware of law, legal rights and duties through a competitive game board method based on random selection or player's discretion.

4 Claims, 9 Drawing Figures

SPINNER

RECTANGULAR BOX WITH CARDS AND CARD-JACKETS IN PERSPECTIVE

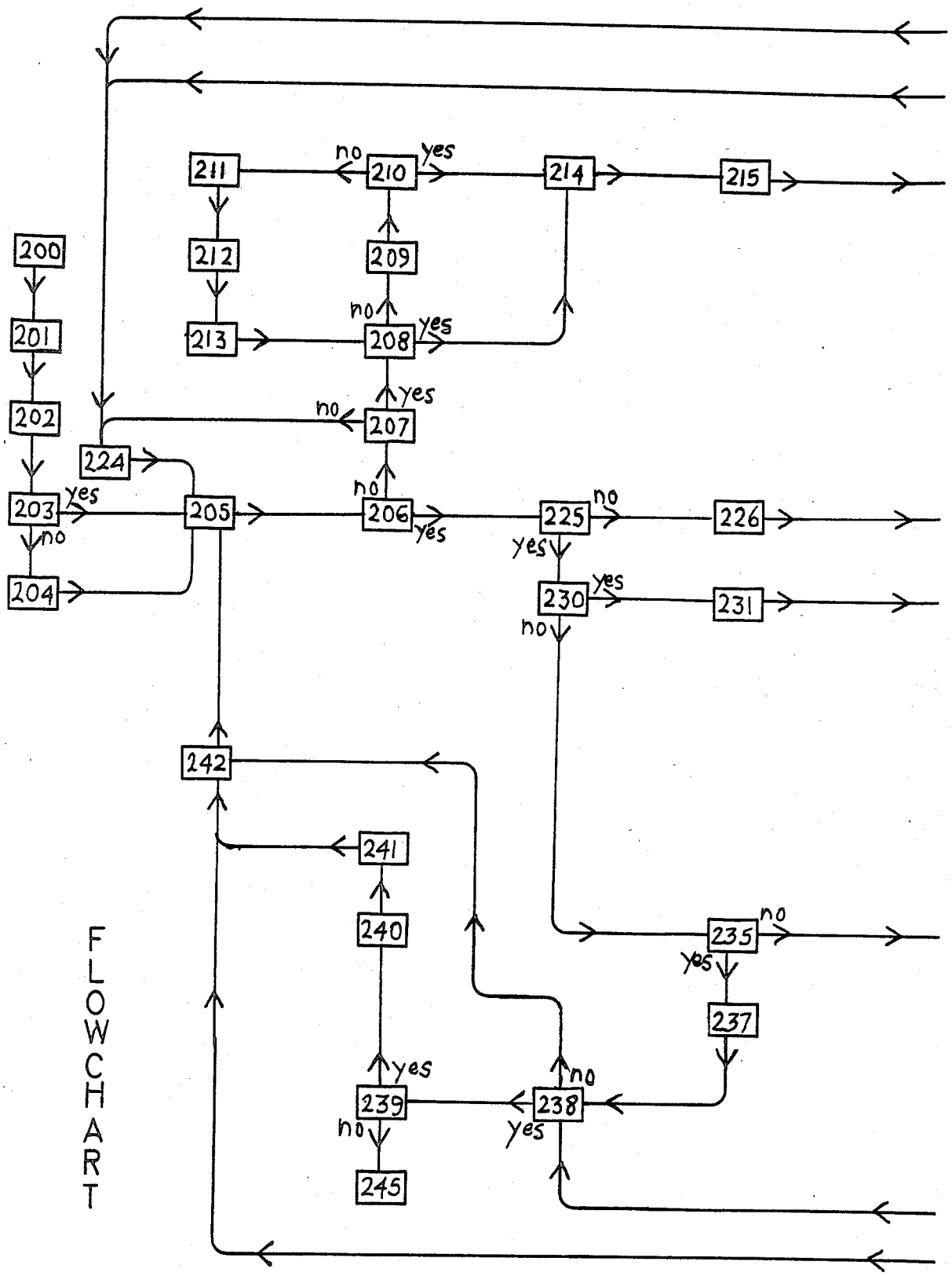
FIGURE 8 SECTION A

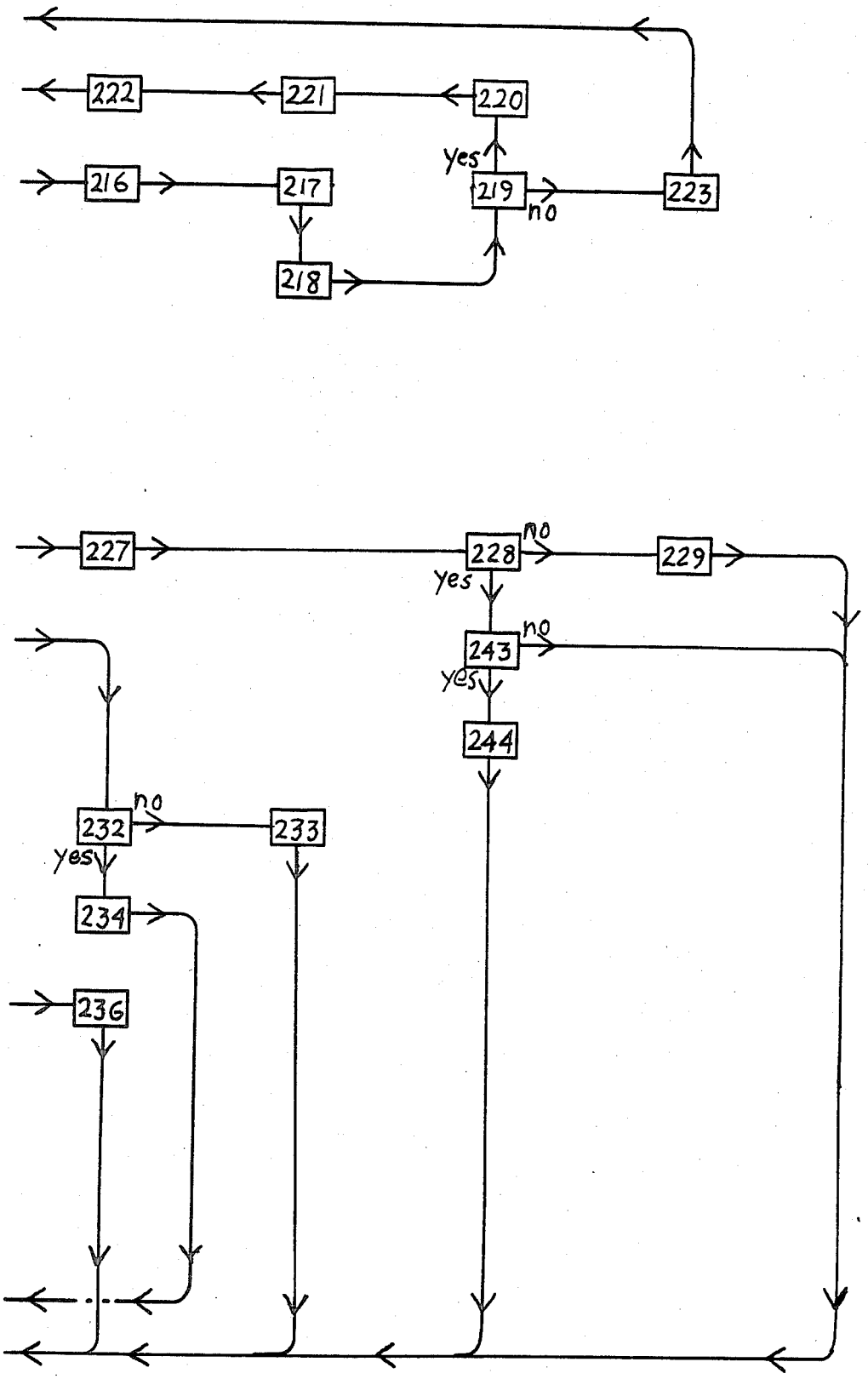
FIGURE 8 SECTION B

FIELDS OF LAW AND LEGAL PROCESS CARD AND BOARD GAME APPARATUS

BACKGROUND

The present invention relates to the field of invention designed to meet the needs of a law-conscious society and which is non-obvious and novel for the entertainment, testing, competition, and teaching ability it possesses in said legal subject matter. By providing the necessary tools with which an individual can learn their legal rights and duties and at the same time profit in their education, an individual can be exposed to knowledge in the basic fundamentals of law as well as knowledge in over 175 specialty areas of law with which he/she may never be exposed to otherwise. In the ordinary use of this field, the present invention relates to a combined educational, entertaining, testing, teaching and competitive board and card game including chance and learning.

Although applicants know of no such prior device so novel and unobvious with which it is most nearly related in said prior art, applicants are not aware of the complete scope of prior art. Current games generally provide little or no probability for achieving any significant teaching process through entertainment in the law field, especially encompassed in such a far-reaching spectrum. One popular game, for example, Trivial Pursuit, which although applicants have not in fact played themselves, are of the opinion that no beneficial or useful knowledge or any significant learning benefit to individuals or society other than for entertainment purposes is offered.

People encounter law every day without realizing that what they encounter involves a law. Our game provides a simple, yet unique and complete format for educating while entertaining.

Heretofore, people interested in legal subject matter had to spend hours reading books and researching to find their needed information. In our game they will have access to this type of specialized information through a means of entertainment.

In encountering legal counsel, our game can aid actual clients in knowledgeable interaction with their attorneys by being legally aware and equipped and also to make them feel that they are not merely playing a passive role. This way even the layman can have access to certain specialized subject matter.

Law, unlike the practice of medicine, requires that the practicing attorney be licensed in each particular state in which he practices, as the law varies from state to state and country to country. On the other hand, a licensed doctor may practice from state to state, and country to country and the scientific medical standards remain the same.

Our game involves law, i.e., legal processes, case law, fields of law, state laws, case precedents, legal terminology, legislative history, executive, judicial and legislative branches and/or processes, treaties, statutes, ordinances, bills, substantive and/or procedural law, comparative legal processes, legal aspects, variations of law contained therein, and legal lexicon, thus it can entail the entire scope of law in so doing.

Many people may have the intelligence, desire, and ability to learn the education our game offers, but don't have the opportunity (financially or otherwise) or access to use their intelligence and ability. Many people who don't have the finances or opportunity to go to school (college, graduate school, law school, etc.) due to non-admittance to school or lack of finances, or time inconvenience will be able to be entertained and learn through our game. An access to education and particularly the opportunity to learn in these specialized areas especially in such a far-reaching spectrum will thereby be provided.

Our game covers legal processes and legal positions, substantive law, procedural law, the form of law, the substance of law, its very essence and also its very process.

The law was and is formed as a societal inheritance for the whole of the people which belongs to all the people. Now is the time for all the people to have the opportunity to learn about that which governs their lives and everyday activities.

This knowledge can help them in their jobs, in their interactions with others and society and it can bring about a well informed society.

Our game can teach people their legal duties and rights and thereby give them a higher regard for the law and coming to appreciate the law will thereby result in their respect for the law. Knowledge of the law will bring about an awareness of the law that they otherwise might never learn or appreciate. This can make people feel better about themselves and inspire people as they will feel that they can become an active member playing an active part in law in the real world and not just on a gameboard.

Our game will give people a better understanding of the law which is a societal imperative some people spend their entire lives devoted to practice and defend.

It is our intent and object of the present invention to promote discussion, mental reasoning and legal thought-processes. It is also our intent and object of the present invention to provide a unique and distinctive function, manner, process, and design which may be easily adapted for use in many foreign languages and different countries. However, since applicants have little or no command in the use of said foreign languages, we will henceforth describe a possible English language equivalent with the understanding that there may be a plethora of foreign linguistic differences which we intend to include within the scope of our invention.

Another object of the present invention is to provide a format which may, through various adaptations encompass or entail many aspects of law in one (or more) educational entertainment device(s) not limited to simple legal terminology. A further intent is to provide facts of legal form and content substantively and procedurally in special legal fields and to impart said facts to the public in an entertaining manner. It is our intent that our game associate learning with fun and thereby achieve and encourage learning the law as a desired result. OUr game will expose players to knowledge they might never have the opportunity to be exposed to otherwise. Our game is for people of various age groups and is a teaching and testing game. An example of those people, who may benefit from our game include: laymen, housewives, students, non-students, those not fortunate enough to be accepted to college, graduate school, law school, and even those who are, practicing attorneys who would not be exposed to areas of law in which they do not practice, retired attorneys, both legal and non-legal oriented individuals, including, but not limited to, doctors, professionals, non-professionals, skilled and non-skilled workers, white collar and blue collar workers alike, whether employed or unemployed.

Our game, although novel and unobvious, has made use of every letter of the alphabet to integrate intricacies of law in one unique format, and although there may be certain letters not associated with particular fields of law in that lettered category, there may be case names, bills (that often take on the names of people who introduce them), legislation, etc. that may be of interest which can be fashioned in an ecclectic manner. Most importantly, our game will encourage and provide the legal awareness which is demanded by and needed in today's society both in the United States and worldwide. Our game is designed to meet the needs of a law-conscious society by providing the necessary tools with which an individual can learn their legal rights and duties and at the same time profit in their education while enjoying a leisurely, funfilled game of mental stimulating activity as a worthwhile passtime.

All citizens must obey and follow the law and are subject to sanctions or legal consequences. The law consists of the rules and standards of the government that each citizen is responsible for and must follow accordingly for the common good. Every citizen holds his life, liberty, property and immunities under the protection of general rules which govern society. The law is promulgated by government as a means to an ordered society. Our game has advantages over the other prior art in that ours goes far beyond the object of winning the game, for more is to be won by playing our game, a more informed, more knowledgeable people will be the result with a better understanding of their place in society with respect to their legal rights and duties as a citizen. Our game involves a learning tool by which not only the player is entertained by the game and winning competition involved, but long after the game is played, the player should emerge with more beneficial knowledge which can remain with him after the game. Each time the player is exposed to the game, his knowledge of the law can increase and thereby attain a better understanding of both the mechanics and structure, along with the formation of the law itself, its ever changing processes in the judicial, legislative, and executive branches, including both the substance of the law and the form of the law, substantively and procedurally, definitionally, legally, and equitably, including, but not limited to cases, history, statutes, terms, etc.

Our game is the only one which gives access to all citizens the opportunity for knowledge of the rules by which they must live in our society. Only our game makes this knowledge available and possible to all easily.

Our game involves the rules by which each and every citizen's actions are governed.

Ours is the only game which states what the law is, at any particular time, helps explain how it works, and then teaches it in a simple, understandable manner in a funfilled fashion to the citizens who must abide by it.

Further objects and advantages of our invention should become apparent from a consideration of the drawings and ensuing description thereof.

BRIEF DESCRIPTION OF DRAWINGS

FIG. 8 is a flowchart divided into sections A and B. This actually helps us explain how each step of our game format is played and includes a description of game rules and game processes.

DETAILED DESCRIPTION OF PREFERRED EMBODIMENT

Figure 1:
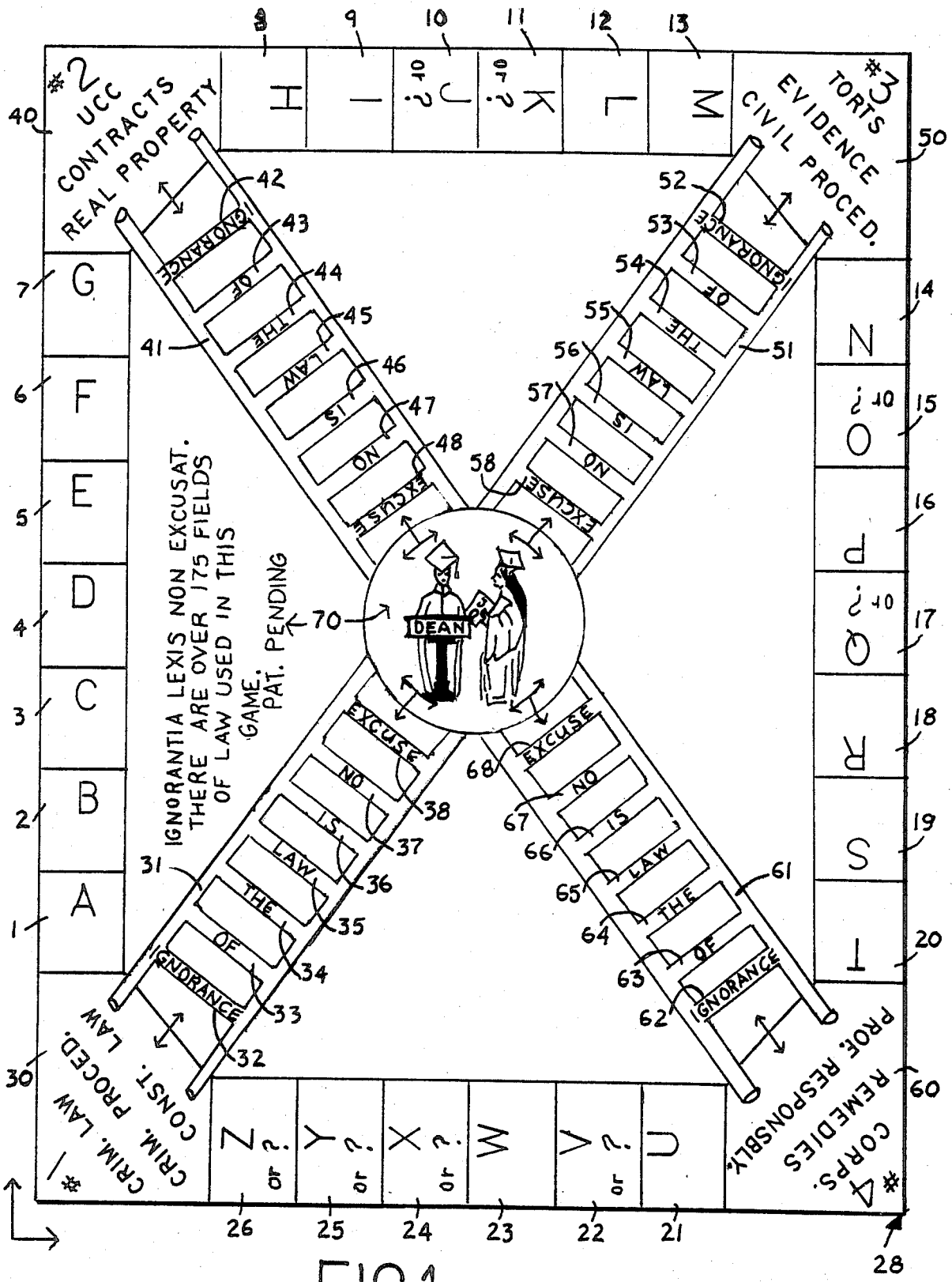
FIG. 1 is our English equivalent plan view of our gameboard.

It can be seen that FIG. 1, #28 is the English Equivalent of our gameboard consisting of a series of twenty-six rectangular spaces, (FIG. 1, #1 through #26), four five-sided corner spaces (FIG. 1, #30, #40, #50, and #60) which give access to the ladders, four ladder pathways (FIG. 1, #31, #41, #51, and #61) which have ladder rungs or spaces (FIG. 1, #32 through #38, #42 through #48, #52 through #58, and #62 through #68 respectively), and one circular Dean's/winner's circle (FIG. 1, #70) which bears the Latin phrase "Ignorantia Lexis Non Excusat" (which means that "Ignorance of the Law is No Excuse" in English), (which we prefer to name our game), states that there are over 175 fields of law used in our game, and that our game is patent pending.

GAME

Figure 2:
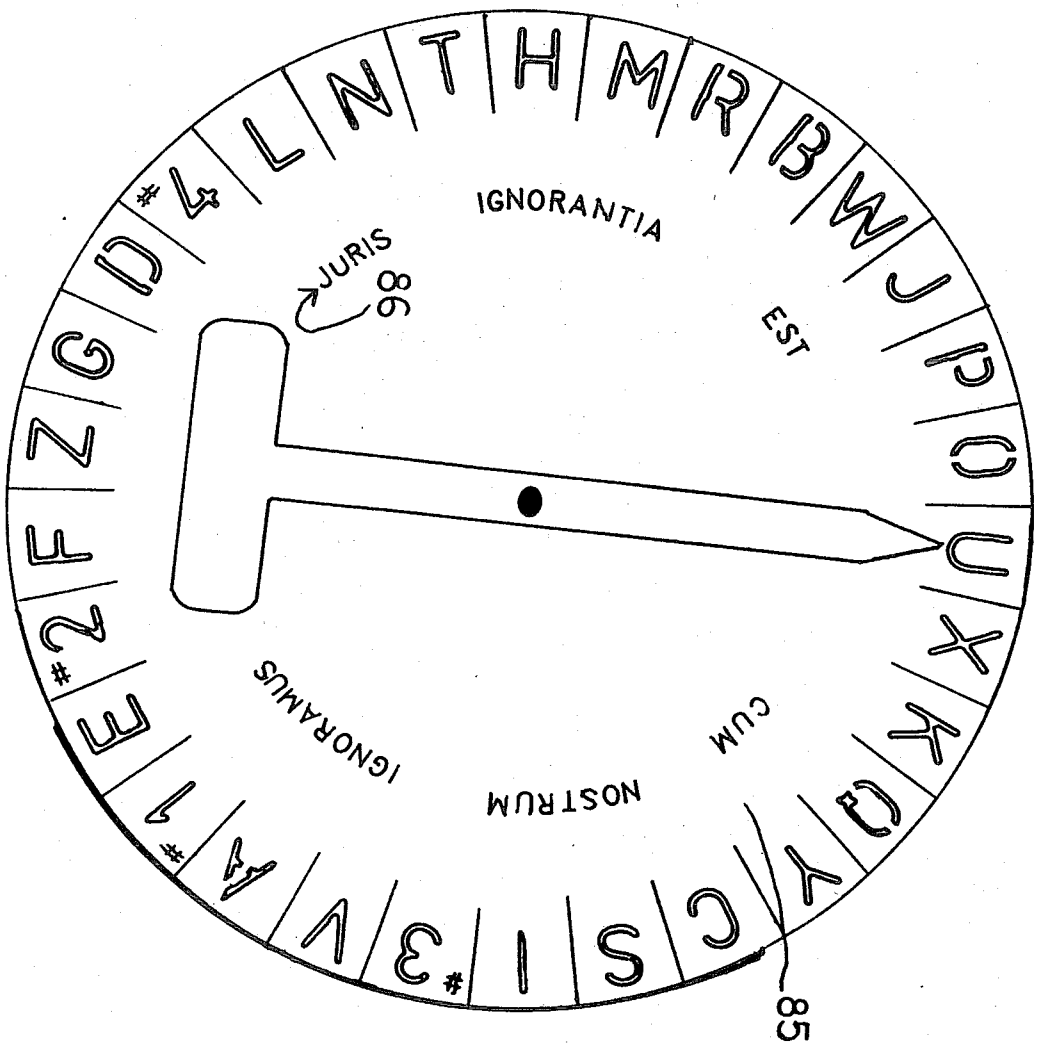
FIG. 2 is a perspective representation of our chance device (spinner).

A game consisting of a gameboard (FIG. 1, #28), cards (FIG. 5, #180), cardbox (FIG. 3, #90), card-jackets (FIG. 6, #181), gamepieces (FIG. 4, #75) and a spinner (FIG. 2, #85). Said spinner allows the players to advance at his/her respective turn by a chance spin to a letter (FIG. 1, #1–26) or number (FIG. 1, #30, #40, #50, and #60) on said board which will determine in which field of law or legal terminology or type of legal process they will be asked a question (FIG. 5, **#180*a*) to which they must give an answer (FIG. 5, #180*c***). The question may be multiple choice, yes/no, true/false, fill in the blank, name a missing element, an answer is given as the question and the answer will be to state the question, a straight answer to a question, matching, find an error in a statement of law, identifying an issue of law, or any other variety. The question asked will contain matter derived from either a specific area of law, for example, a spin on letter "U" would result in player advancing his/her gamepiece to that respective location on the gameboard, therefore, landing on "U" for example could:

1. involve a question in a specific field of law beginning with the letter "U" such as "Unfair Trade Practices", or 2. may involve legal terminology beginning with the letter "U" from a field of law beginning with a letter other than "U", (ex. Contracts Law may involve the legal term "Usery" or 3. may involve legal terminology beginning with a letter other than "U" in a field of law beginning with the letter "U", (ex. the law of Uninsured Motorist Law may involve the legal term "Contributory Negligence") or 4. may involve legal terminology beginning with the letter "U" in a field of law beginning with the letter "U", (ex. the law of Unfair Trade Practices may involve the legal term "Usurp"), or 5. may involve a legal process (i.e., statute, etc., aside from a field of law or legal terminology per se) beginning with the letter "U" (ex. United Nation Charter), 6. may involve a legal process not beginning with the letter "U", whereas, 7. a spin on a number (1–4) would result in a question involving a required law category (in this particular embodiment) corresponding to that respective number (corner category).

8. Additionally, some alphabet letters are surprise category letters which may additionally involve fields of law and/or legal terminology or legal processes aside from that respective letter. In this particular embodiment the purpose for this is because at this particular time there are little or no fields of law beginning with certain particular letters. The letters which contain said surprise categories in this preferred embodiment are letters "J", FIG. 1, #10, letter "K", FIG. 1, #11, Letter "O", FIG. 1, #15, letter "Q", FIG. 1, #17, letter "V", FIG. 1, #22, letter "X", FIG. 1, #24, letter "Y", FIG. 1, #25, and letter "Z", FIG. 1, #26.

Additionally, landing on one respective letter may be a hint to the player as to what category of law may be involved, i.e., landing on "A" for example could involve a question regarding "Antitrust" or "Assault".

The numbers on said spinner correspond to the numbers on said gameboard which are located in the four corners of the gameboard. Each number represents three categories of law which in turn represent required courses for graduation from law school (so as to make our game as close as possible to learning law in real life situations). These include: Category #1, FIG. 1, #30, which covers Criminal Law, Criminal Procedure, and Constitutional Law.

Category #2, FIG. 1, #40 covers Contracts, Real Property, and the Uniform Commercial Code.

Category #3, FIG. 1, #50 covers Torts, Evidence and Civil Procedure.

Category #4, FIG. 1, #60 covers Remedies, Corporations and Professional Responsibility.

Additionally, this particular embodiment is subject to adaptation for an altered embodiment such as "pass the bar" wherein the required categories for graduation would be substituted by required categories for passing the bar. Another altered embodiment could include some other variety by substitution or supplementation of said cards and/or stickers or transparencies for the gameboard spaces which we intend to be part of this invention, or for instance, a player landing on any lettered space could, with the correct answer, be given a bonus such as an extra turn to spin or advancement to another game space on the board.

In this manner, the players will become aware of law through this preferred embodiment question and answer method.

This preferred embodiment will involve chance as to which questions are asked (except for a possible adaptation of an embodiment in which the players may elect decks of cards within specialized fields of law and/or processes, etc. of their interest to substitute at certain corner categories and/or board letter categories) and the game involves a learning process whereby the players will learn the law encountered in day-to-day activities as well as specialty areas of law.

GAMEBOARD

The gameboard (FIG. 1, #28) consists of 26 spaces which correspond to the English alphabet letters A–Z (FIG. 1, #1–#26) and 4 spaces which correspond to numbers 1–4 (FIG. 1, #30, #40, #50, and #60). These 30 spaces entail over 175 fields of law plus legal terminology and legal processes of law (and for which different gameboard variation embodiments may be utilized). The corner spaces which correspond to said numbers are specialized spaces which include three areas of law in each corner space. Each of the four ladders contain seven rung/spaces which lead to the center of the board or the winner's circle in which the Dean is located and the player at that location can simulate receiving his degree as winner. On each rung/space of the ladder is displayed a word of the preferred name of our game which spells out the name of our game, "Ignorance of the Law is No Excuse. " Inside the winner's circle are displayed the words "Patent Pending", "There Are Over 175 Fields of Law Used in This Game", and the latin phrase "Ignorantia Lexis Non Excusat" which means in English "Ignorance of the law is no excuse. " When the player lands on a number, thereby gaining access to the ladder in which he can advance to the Dean's/winner's circle, he will then have to first answer a question correctly from a field of law which is a requisite course in law school in the United States to graduate. Thereafter it will be that player's choice as to whether he wishes to continue answering questions to those required areas or he may instead elect to return to the spinner to spin and be asked questions from the gameboard alphabet or number for which he spins for by said chance device. Regardless of his choice, a correct answer will initially be necessary to allow him to progress up the ladder toward the Dean with the chance to receive his degree and win the game if he so chooses. He may then simulate graduating from law school and receiving his law degree (1) J. D., Juris Doctor, or (2) subsequently his L.L.M., Master of Law, by the same process. This is the risk and daring aspect of our game as the players may elect to continue to play indefinitely rather than winning when they have the chance to win. Team strategy (a tournament or equivalent for example) and competition may result.

SPINNER

A player will spin the spinner to determine where to place his gamepiece (FIG. 4, #75) on the gameboard (FIG. 1, #28). As shown in FIG. 2, #85, the spinner is pointing to the letter "U". The player spins the gavel respresentation which will point to a letter or number on said spinner. The corresponding letter or number on the gameboard is the location where the player will advance his/her respective gamepiece.

It can be seen that there are many other possible embodiments (such as foreign language equivalents and arrangements) for our spinner which we intend to include in the scope of our invention.

The spinner (FIG. 2, #85) consists of a circular figure with the pointer instrument which may resemble a gavel in the middle of the spinner which is spinned to determine the location on the gameboard which allow the players to advance their gamepiece on said board. The spinner bears the latin phrase (FIG. 2, #86) "Juris Ignorantia Est Cum Nostrum Ignoramus", read clockwise from bottom left which means in English " It is ignorance of the law when we are unfamiliar with our rights:" (which we may choose to also put in English). The alphabet and numbers which are on the gameboard are reproduced on and correspond to the spinner and cards.

CARDBOX

Figure 3:
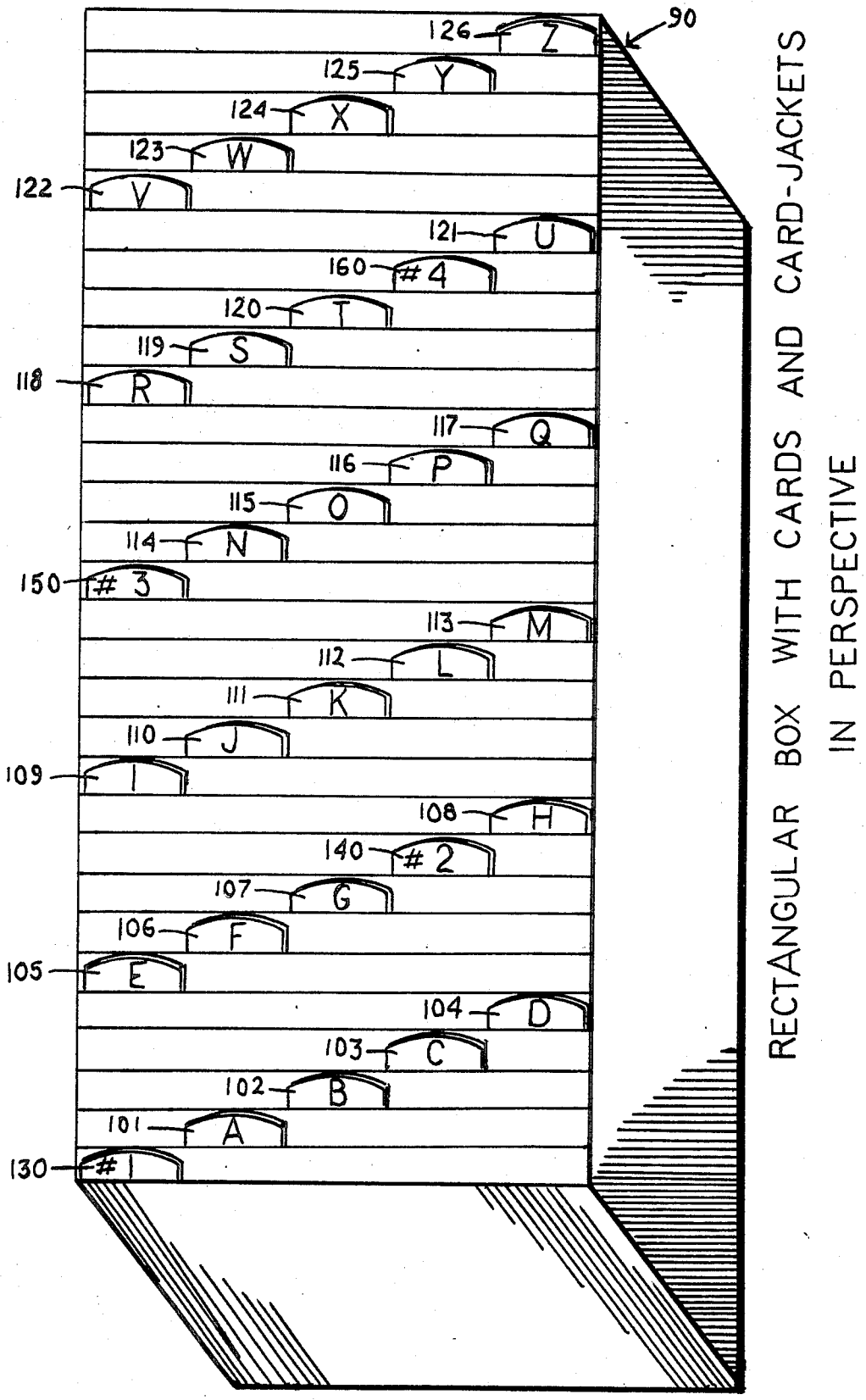
FIG. 3 is a perspective representation of a rectangular box with game cards and game card-jackets.
Figure 5:
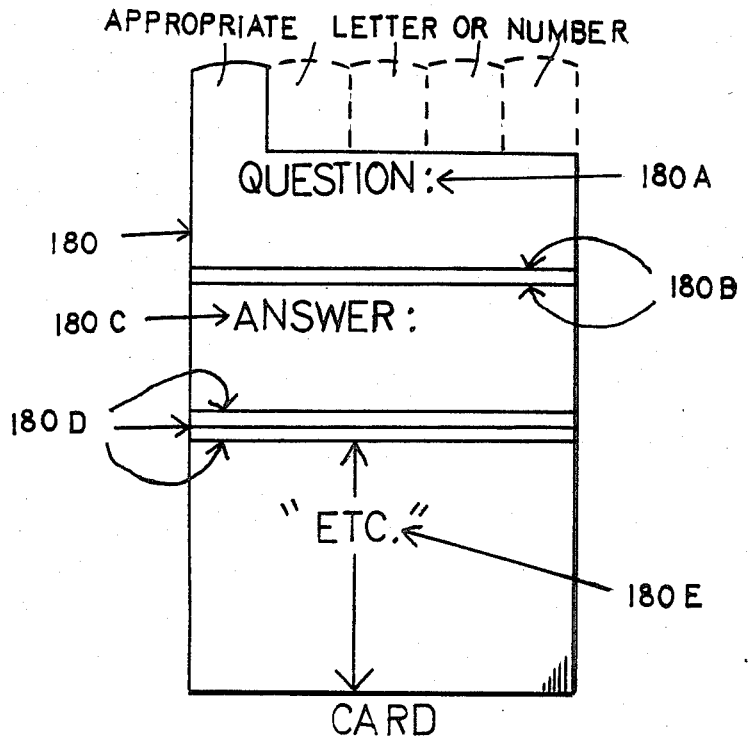
FIG. 5 is a perspective representation of a game card.
Figure 6:
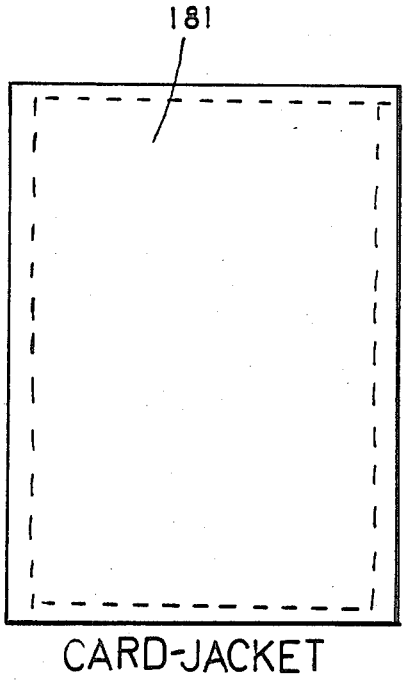
FIG. 6 is a perspective representation of the game card-jacket (or envelope) which covers a game card.

FIG. 3, #90 is a perspective representation of a rectangular box with game cards (FIG. 5, #180) and game card-jackets (FIG. 6, #181). The box contains game cards in their jackets ranging from alphabet letters A–Z and numbers 1–4 which correspond to the spaces on the gameboard and spinner.

A questioner player draws a card (FIG. 5, #180) from said category, (FIG. 3, #101–#126, #130, #140, #150, or #160), which corresponds to the letter or number from which questionee player spun (FIG. 2, #85). If the card is a letter, a question from said letter category is asked; if the card is a number, a question from said number category is asked. When a questionee player spins a letter category question, he advances to that letter whether he subsequently answers the questions correctly or incorrectly. If a questionee player answers a number category correctly, he has the chance to advance up the ladder to the Dean's/winner's circle (with each correct answer he advances one rung at a time). A player located on a ladder rung who incorrectly answers a question must go backward down the ladder a rung which is only applicable to a player who has never yet completely reached the Dean's circle. A player who has access to any ladder after answering one question correctly and advancing up one rung of the ladder, may (1) choose to continue answering questions from that respective corner category at the time of their respective turn or (2) choose instead to return to the spinner and answer questions to the numbered and lettered categories. If a player advances all the way to the top of the Dean's/winner's circle, he may elect whether to receive his degree and win the game or whether to (1) receive his J.D. degree and continue back down and up any ladder again to receive his L.L.M. degree and win the game or (2) continue playing the game. A player who makes it to the Dean's circle may at that point, if he continues to play, choose to go back down at different ladder from which he advanced up from. This way the player will have access to different corner categories of law if he chooses to be asked questions from the respective corner category as opposed to the lettered categories on the board.

However, a player going back down the ladder may not advance back up the ladder in the event he misses a question. He must first complete going back down the ladder first before continuing back up. He is neither penalized nor allowed to cheat but rather must remain on his respective rung location in such event.

GAME CARD

The game card (FIG. 5) consists of a tab protruding upward in order to allow an alphabet letter or number to be viewed while the card is placed inside the box which holds the cards. Each card consists of a question (FIG. 5, #180*a*) followed by a double separation line (FIG. 5, #180*b*) underneath it and thereafter underneath the separation line appears the answer (FIG. 5, #180*c*). After the answer appears a triple separation line (FIG. 5, #180*d*) which separates the answer to the first question from the next question. Depending upon the question of law, the number of questions and answers on any one card may vary from card to card. FIG. 5, #180*e*, the "etc." portion of the card represents consecutive questions and answers to the end of that particular card. Additionally, the tab protrusions may be adapted for an embodiment allowing questions on the front portion of the card and answers on the back of the card. Our idea was originally conceived as a type of ballot. We felt it more economically feasible to design the structure as said cards are represented herein. However, it is our intention to include in our scope of the game that someone skilled in the art may find a more economic method of production wherein a possible change in said cards (FIG. 5, #180(*c*) and 180(*d*)) may be produced without the separation lines, possibly using both sides of the cards, also, possibly eliminating the need of card-jackets. Use of advanced technology process may be utilized in lieu of present structure of the preferred embodiment of said cards represented herein.

A questioner player takes a card (FIG. 5, #180) from the respective letter (ex. "U" as shown on spinner FIG. 2, #85) in the cardbox (FIG. 3, #90) (ex. ∫U", FIG. 3, #121) or number to which he spun and asks the questionee a question from said card category to which he must answer.

The competitive process continues until someone lands on a number gaining access to the ladder, advances up the ladder to the Dean's/winner's circle and chooses to win the game. However, the successful player may opt not to win the game at that point wherein the game will continue the same process (except in the event player is being penalized, see flowchart below). Supplemental card decks with legal subject matter could be substituted or altered for any corner category or any lettered or numbered spaces in other embodiments.

DESCRIPTIVE LEGAL SUBJECT MATTER, ET. AL.

Within the rectangular cardbox (FIG. 3, #90), contain cards (FIG. 5, #180), tabulated with respective letters A–Z (FIG. 3, #101–126) respectively, and numbers #1–4, (FIG. 3, #130, #140, #150, and #160). These numbered and lettered card categories may include, but are not limited to the following fields of law or legal terminology associated with that field of law or that respective letter and correspond to various positions on the spinner (FIG. 2, #85) and gameboard (FIG. 1, #28) as can be seen.

Our representation of FIG. 3, #101, may include, but is not limited to the following fields of law and/or legal terminology: Accident & Health Insurance Law, Administrative Law, Admirality Law, Adoption Law, Agriculture Law, Aircraft Title Law, (Aviation), Antitrust Law, Alabama Law, Alaska Law, Arizona Law, and Arkansas Law. Legal terminology associated with said letter "A" may include, but is not limited to the legal terms "Abandonment through Award."

Our representation of FIG. 3, #102, may include, but is not limited to the following fields of law and/or legal terminology: Banking Law, Bankruptcy Law, Bioethics Law, and Business Law. Legal terminology associated with said letter "B" may include, but is not limited to the legal terms "Backdating through By the Entirety."

Our representation of FIG. 3, #103, may include, but is not limited to the following fields of law and/or legal terminology: Casino Law, Casualty Insurance Law, Cemetery Law, Chancery Practice Law, Civil Practice Law, Civil Rights Law, Civil Service Law, Collection Law, College Law, Commercial Law, Commodities Law, Communication Law, Constitutional Law, Consumer Law, Contracts Law, Cooperative Law, Copyright Law, Corporate Financing Law, Corporate Reorganization & Insolvency Law, Corporation Law, Credit Union Law, Creditors' Rights Law, Criminal Law, Criminal Tax Law, Custody Law, Customs Law, California Law, Colorado Law and Connecticut Law. Legal terminology associated with said letter "C" may include, but is not limited to the legal terms "Call through Cypres."

Our representation of FIG. 3, #104, may include, but is not limited to the following fields of law and/or legal terminology: Defense of Driving Under the Influence (DUI) and/or Drug Cases Law, Divorce Law, Domestic Relations Law, Drainage and Levee Law, Delaware Law and District of Columbia Law. Legal terminology associated with said letter "D" may include, but is not limited to the legal terms "Damages through Dying Declaration."

Our representation of FIG. 3, #105, may include, but is not limited to the following fields of law and/or legal terminology: Election Law, Eminent Domain Law, Employee Benefit Law, Employee Stock Ownership Plans and Financing Law, employment Law, Energy Law, Entertainment Law, Environmental Law, Equal Opportunity Law, Equity Practice Law, Estate Planning Law, Export Law and Regulation. Legal terminology associated with said letter "E" may include, but is not limited to the legal terms "Easement through Eyewitness."

Our representation of FIG. 3, #106, may include, but is not limited to the following fields of law and/or legal terminology: Family Law, Federal Employers' Liability Law, Federal Income Law, Federal Estate and Gift Tax Law, Federal Power Law, Federal Practice Law, Fidelity and Surety Law, Financial Institution Law, Fire Insurance Law, Food, Drug, and Cosmetic Law, Foreign Patent Law, Franchise Law, and Florida Law. Legal terminology associated with said letter "F" may include, but is not limited to the legal terms "Fabricate through Futuri."

Our representation of FIG. 3, #107, may include, but is not limited to the following fields of law and/or legal terminology: General Negligence Trials & Appeals, Government (or Public) Contract Law, and Georgia Law. Legal terminology associated with said letter "G" may include, but is not limited to the legal terms "Gainful Employment through Guilty."

Our representation of FIG. 3, #108, may include, but is not limited to the following fields of law and/or legal terminology: Health Care and Hospital Law, Health Care Law-Antitrust, Historic Preservation Law, Housing & Urban Development Law and Hawaii Law. Legal terminology associated with said letter "H" may include, but is not limited to the legal terms "Habeas Corpus through Hung Jury."

Our representation of FIG. 3, #109, may include, but is not limited to the following fields of law and/or legal terminology: Immigration & Nationality Law, Indian Affairs Law, Insolvency Law, Insurance Law, International Business Law, International Law, International Trade Commission Law, Interstate Commerce Law, Interstate Land Sales Law, Invasion of Privacy Law, Illinois Law, Indiana Law, and Iowa Law. Legal terminology associated with said letter "I" may include, but is not limited to the legal terms "Ibid through Issue".

Our representation of FIG. 3, #110, may include, but is not limited to the following fields of law and/or legal terminology: Japanese Negotiations Law and Juvenile Law. Legal terminology associated with said letter "J" may include, but is not limited to the legal terms "Jail through Juvenile Delinquent." Additionally, this a surprise category on the board and may include fields of law and/or any legal terms aside from the letter "J".

Our representation of FIG. 3, #111, may include, but is not limited to the following fields of law and/or legal terminology: Kentucky Law. Legal terminology associated with said letter "K" may include, but is not limited to the legal terms "Kidnapping through Knowingly." This is a surprise category on the board and may include any fields or law and/or any legal terms aside from the letter "K".

Our representation of FIG. 3, #112, may include, but is not limited to the following fields of law and/or legal terminology: Labor Law, Landlord & Tenant Law, Legal Ethics & Discipline Law, Legislative Practice, Libel & Slander Law, Licensing Law, Life Insurance Law, Liquor Control Law, Literary Property Law, Litigation Law, Livestock Law, Local Practice (Wash. D.C. only) and Louisiana Law. Legal terminology associated with said letter "L" may include, but is not limited to the legal terms "Labor Union through Lost Property."

Our representation of FIG. 3, #113, may include, but is not limited to the following fields of law and/or legal terminology: Malpractice Law, Marine & Inland Marine Insurance Law, Maritime Law, Maritime Negligence Law, Matrimonial Law, Medical Health Law, Military Law, Mining Law, Mortgage Law, Motion Picture Law, Motor Carrier Law, Municipal Bond Law, Municipal Finance Law, Municipal Law, Maine Law, Maryland Law, Massachusetts Law, Michigan Law, Minnesota Law, Mississippi Law, Missouri Law and Montana Law. Legal terminology associated with said letter "M" may include, but is not limited to the legal terms "Magistrate through Mutual Mistake."

Our representation of FIG. 3, #114, may include, but is not limited to the following fields of law and/or legal terminology: Natural Resources Law, Negligence Law, Nuclear (or Atomic) Law, Nebraska Law, Nevada Law, New Hampshire Law, New Jersey Law, New Mexico Law, New York Law, North Carolina Law and North Dakota Law. Legal terminology associated with said letter "N" may include, but is not limited to the legal terms "Narcotics through Nuptial."

Our representation of FIG. 3, #115, may include, but is not limited to the following fields of law and/or legal terminology: Oil and Gas Law, Ohio Law, Oklahoma Law, and Oregon Law. Legal terminology associated with said letter "O" may include, but is not limited to the legal terms "Oath through Ozone." This is a surprise category on the board and may include fields of law and/or legal terminology aside from the letter "O".

Our representation of FIG. 3, #116, may include, but is not limited to the following fields of law and/or legal terminology: Partnership Law, Patent Law, Pension & Profit Sharing Law, Personal Injury Law, Poverty Law, Probate Law, Products Liability Law, Professional Liability Law, Project Finance Law, Public Authority Financing Law, Public Employment Relations Law, Public Improvement Law, Public Land Law, Publishing Law and Pennsylvania Law. Legal terminology associated with said letter "P" may include, but is not limited to the legal terms "Pain and Suffering through Putative Spouse".

Our representation of FIG. 3, #117, may include, but is not limited to the following fields of law and/or legal terminology: "Quantum Meruit through Quo Warranto". This is a surprise category on the board and may include fields of law and/or legal terms aside from the letter "Q".

Our representation of FIG. 3, #118, may include, but is not limited to the following fields of law and/or legal terminology: Radio Law, Railroad Law, Read Estate Law, Reorganization Law, Retirement Plans and Rhode Island Law. Legal terminology associated with said letter "R" may include, but is not limited to the legal terms "Rape through Rule Against Perpetuities".

Our representation of FIG. 3, #119, may include, but is not limited to the following fields of law and/or legal terminology: Savings & Loan Law, School Law, Securities Law, Selective Law, Selective Service Law, Shopping Center Law, Social Security Disability Law, Space Law, Subrogation Law, Surety Law, South Carolina Law and South Dakota Law. Legal terminology associated with said letter "S" may include, but is not limited to the fields of law and/or legal terms "Sale through Symbolic Delivery."

Our representation of FIG. 3, #120, may include, but is not limited to the following fields of law and/or legal terminology: Taxation Law, Tax Litigation & Appeals, Television Law, Timber & Logging/Lumber Law, Tort Law, Trademark Law, Trade Regulation Law, Transportation Law, Trial Practice—Civil, Trial Practice—Criminal, Trust Law, Tennessee Law and Texas Law. Legal terminology associated with said letter "T" may include, but is not limited to the legal terms "Tail (fee) through Tying Arrangement."

Our representation of FIG. 3, #121, may include, but is not limited to the following fields of law and/or legal terminology: Unfair Competition Law, Uninsured Motorist Law, University Law, Urban Affairs Law, Utility Law and Utah Law. Legal terminology associated with said letter "U" may include, but is not limited the legal terms "Ultimate Facts through Utter."

Our representation of FIG. 3, #122, may include, but is not limited to the following fields of law and/or legal terminology: Vermont Law and Virginia Law. Legal terminology associated with said letter "V" may include, but is not limited to the legal terms "Vacate through Vow." This is a surprise category on the board and may include fields of law and/or legal terminology aside from the letter "V".

Our representation of FIG. 3, #123, may include, but is not limited to the following fields of law and/or legal terminology: Wage & Hour Law, Water Rights Law, Workmen's (or Worker's) Compensation Law, Worker's Compensation Law, Washington Law, West Virginia Law, Wisconsin Law and Wyoming Law. Legal terminology associated with said letter "W" may include, but is not limited to the legal terms "Waiver through Wrongful Life."

Our representation of FIG. 3, #124, may include, but is not limited to the following fields of law and/or legal terminology: "X Chromosome through X-ray". This is a surprise category on the board and may include fields of law and/or legal terminology aside from the letter "X".

Our representation of FIG. 3, #125, may include, but is not limited to the following fields of law and/or legal terminology: "Yacht through Yick Wo Doctrine". This is a surprise category and may include fields of law and/or legal terminology aside from the letter "Y".

Our representation of FIG. 3, #126, may include, but is not limited to the following fields of law and/or legal terminology: Zoning Law. Legal terminology associated with said letter "Z" may include, but is not limited to the legal terms "Zealous through Zoning." This is a surprise category on the board and may include fields of law and/or legal terminology aside from the letter "Z".

Our representation of FIG. 3, #130, may include, and in this particular embodiment is limited to the following fields of law and/or legal terminology: Criminal Law, Criminal Procedure, and Constitutional Law.

Our representation of FIG. 3, #140, may include, and in this particular embodiment is limited to the following fields of law and/or legal terminology: UCC, Contracts, and Real Property.

Our representation of FIG. 3, #150, may include, and in this particular embodiment is limited to the following fields of law and/or legal terminology: Torts, Evidence, and Civil Procedure.

Our representation of FIG. 3, #160, may include, and in this particular embodiment is limited to the following fields of law and/or legal terminology: Corporations, Remedies, and Professional Responsibility.

This particular embodiment includes categories for simulating receiving the degree of J.D., Juris Doctor. Different categories for FIG. 3, #130, #140, #150, and #160 may be replaced for an embodiment providing for a "passing the bar" embodiment wherein the categories required for graduation would be substituted by categories required for passing the bar.

The fields of law and/or legal terminology heretofore referred to are intended to touch upon a multiplicity of legal processes, including, but not limited to the judicial, legislative and executive branches of government, substantive and/or procedural law, case law, statutes, ordinances, bills, case precedents, legal terminology, comparative legal processes, legal aspects and variations of law contained therein, and legal lexicon.

FLOWCHART

Referring to FIG. 8, it can be seen that section A and section B must be viewed as one drawing to supplement this written explanation. The flowchart and this written explanation must be used together to better explain our game process. Please refer to flowchart FIG. 8 and its pathways of progression as applicable in said drawing Figure.

Box #200 represents the beginning (start) of our game.

Figure 4:
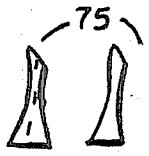
FIG. 4 is a near representation of our game pieces with which to move on the various spaces on the gameboard.

Box #201 represents players choosing a gamepiece (FIG. 4, #75).

At box #202 the players determine in what playing order to play our game. The players decide their playing order.

Figure 7:
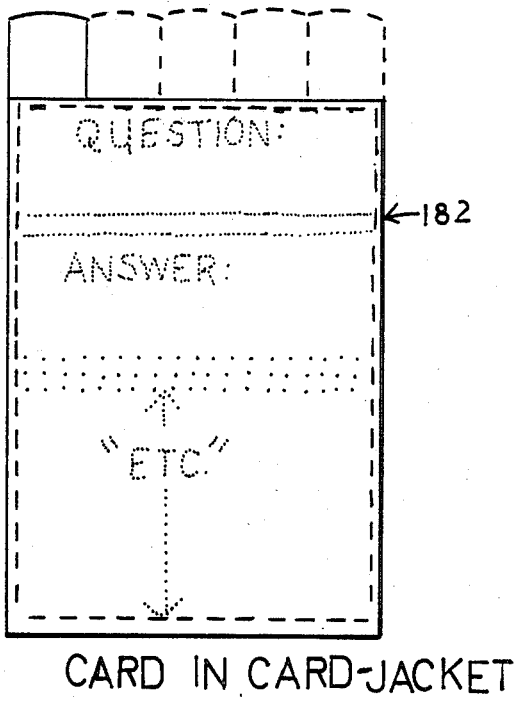
FIG. 7 is a perspective representation of a card-jacket holding a game card.

At box #203 the players must decide "yes/no" if the "first" card, (FIG. 5, #180) in each of the thirty appropriately lettered (FIG. 1, #101–#126) or numbered (FIG. 1, #130, #140, #150, and #160) card categories as arranged in FIG. 3 (#101 through #126, #130, #140, #150, #160) within the cardbox (FIG. 3, #90) is covered with a card-jacket (FIG. 6, #181) as one said "first" card is shown in FIG. 7, #182. If the "no" option pathway is followed, then the players must proceed to #204. If the "yes" option pathway is followed from box #203, then the beginning game format is correct and players may proceed to #205.

Box #204 represents the players correctly arrange the cards (FIG. 5, #180) before starting as described in box #203.

Box #205 represents some rules which consist of the following:

(a) Players cannot ask themselves a question (FIG. 5, #180*a*);

(b) Certain players already on a ladder pathway (FIG. 1, #1–#4) rung (FIG. 1, #32–#38, #42–#48, #52–#58, and #62–#68, respectively) who miss a question must take one step or space backward (i.e. any player who has been unsuccessful at a first attempt or previous unsuccessful attempts before actually reaching the Dean's/winner's circle (FIG. 1, #70) at least once) down said ladder each time he misses a question each respective turn. If player's location is at the bottom rung, (i.e., any "Ignorance" rung, FIG. 1, #32, #42, #52, or #62), player must return back to the corner space location (FIG. 1, #30, #40, #50, or #60, respectively) which gives access to said ladder pathway rung.

(c) Any player proceeding down a ladder to try his/her second or subsequent attempt at (possibly) winning the game by reaching said Dean's/winner's circle who misses a question is not penalized by having to take a step back (which would result in certain instances of going back up thereby allowing cheating) but remains on the respective rung and also must continue completion back down the ladder to said "Ignorance" rung before proceeding back up again. That is to say:

(1) A player who is going in an upward direction towards said Dean's/winner's circle for any first series of unsuccessful attempts before actually reaching said Dean's/winner's circle who misses an answer (FIG. 5, #180*c*), will have to go back a rung on the ladder; whereas, (2) A player who has already progressed up the ladder to said Dean's/winner's circle and could have won the game but chose instead to continue to play the game (the "risk" and "daring" aspects of our game) may at his/her respective turn miss any said question in which case he/she will stay on any ladder rung they are on without any further penalty until his/her next correct answer. This will allow him/her to complete progressing back down the ladder to the bottom rung ("Ignorance" rung) before proceeding back up the ladder again.

At box 206 the player has a "yes/no" pathway to follow regarding whether it is their respective turn or not. Following "yes" pathway indicates it is their turn and to proceed to box #225. Following the "no" pathway indicates it is not their turn and to proceed to box #207.

At box #207 one player must agree that he/she will ask the question and check the answer (termed questioner). However, there may be instances when a player declines to play as questionee (player to whom question is asked) and chooses only to remain a questioner (player who asks questions) throughout the entire game (analogous to a referee). Said one player (questioner) then proceeds by way of the "yes" pathway to box #208. All other players at box #207 then proceed through the "no" pathway to box #224.

Box #224 represents "wait until the next turn" before returning to box #205 to repeat the process.

At box #208 the questioner must determine "yes/no" whether he/she knows where to find the correct question card (FIG. 5, #180) from the appropriate respective card category (FIG. 3, #101–126 and #130, #140, #150, and #160). If the answer pathway "no" is followed, then the questioner proceeds to box #209. If the answer pathway "yes" is followed, then the questioner proceeds to box #214.

At box #209 the questioner looks to the questionee for his/her spin category or ladder decision (i.e. any player on any ladder space has a choice at his/her turn to continue answering questions from their respective ladder access card category or spinning for a new chance category) to determine the correct category from which to select a card (FIG. 5, #180). Thereafter, player proceeds to box #210.

At box #210 there is a "yes/no" pathway to follow pertaining to whether there is another card (FIG. 5, #180) left in that particular category in said cardbox (FIG. 3, #90) (see questionee's ladder decision or spin determination from box #209). If "yes" (see #214 below), said player proceeds with the game at box #214. If "no", player proceeds to box #211.

At box #211 questioner asks questionee whether he/she wishes to omit all questions in said category throughout the rest of the game or whether to start that card category all over again (due to exhaustion of cards, FIG. 5, #180) in that category. The process continues at box #212.

Box #212 represents a "contingent" game rule as follows:

(1) If any player becomes stuck on said ladder pathway (as opposed to merely missing a question in which the player takes a step back)

(a) because said cards (FIG. 5, #180) become used up or (b) risks a spin rather than perhaps exercising the choice of choosing to answer the ladder access category, or (c) for any other reason, (perhaps player strategy) then any player stuck on any ladder space must return to that said ladder's corner access space and lose one turn.

A possible additional embodiment could allow the player who is stuck on the ladder to subsequently spin thereby alowing him to be asked a question on that turn. (These rules, as are all our rules, are meant to be illustrative rather than exclusive rules in any preferred embodiment). Additionally, for purposes of competition, we recognize that there may be inventive players and therefore our game allows them to agree beforehand to alter the rules and form their own unique preconditioned house rules with regard to reaching the Dean's/winner's circle. An example would be changing the number of times the player must advance up the ladder before winning. Thereafter, once that condition is satisfied, the winning player may opt to continue playing.

(2) If a player located on said lettered space on said board spins a category which is exhausted, he will not be penalized by having to move a space backward, but would not be able to spin until his next respective turn. Then proceed to box #213.

Box #213 represents questioner finding out whether questionee spins again (due to the card deck being omitted and having to spin again for a new category). If questionee does spin then the questioner proceeds back to said box #208, in short, "do you know where to get the card (FIG. 5, #180) from?". If yes, player proceeds to box #214.

Box #214 represents that questioner remove first question card (FIG. 5, #180) and card-jacket (FIG. 6, #181) from said cardbox (FIG. 3, #90).

Box #215 represents questioner sliding said card-jacket down to view one question (FIG. 5, #180*a*) and one answer (FIG. 5, #180*c*) no further than the triple dividing lines (FIG. 5, #180*d*) which we represent as separation between said question and said answer and answer from next question (FIG. 5, #180*d*). (Note: Said "first" card may refer to any other question and answer card which is represented in FIG. 5, #180*e*).

At box #216 questioner asks questionee said question.

At box #217 questioner checks said answer to determine whether it is correct or not.

Box #218 represents questioner displaying the answer (FIG. 5, #180*c*) to any player(s) who wish to see it.

At box #219 there is a "yes/no" pathway in which questioner makes a determination as to whether or not the last question and answer (FIG. 5, #180*c*) on that respective card has been asked. If the "yes" pathway is followed (due to it being the end of said card), players proceed to box #220. Determination is made by viewing a double line (FIG. 5, #190*b*) on said card which indicates a separation of a question from an answer and a triple line (FIG. 5, #180*c*) which indicates separation of an answer from the next question (refer to FIG. 5, #180*e*). If the "no" pathway is followed see box #223 below.

At box #220 the questioner player removes said card-jacket (FIG. 6, #181) from said card (FIG. 5, #180) since no question and answer are left on that particular card.

At box #221 the questioner player sets said card aside.

At box #222 the questioner player places said card-jacket (FIG. 6, #181) on the next card in that card category unless all those respective cards (FIG. 5, #180) are exhausted whereby player would set card-jacket (FIG. 6, #181) aside too (see the player's decision path from #211 on) and proceeds to box #224.

At box #223 player puts said card back in said card-box (FIG. 3, #90) in its original location for further use and then proceeds to #224.

At box #224 players wait until next turn.

At box #206 above, following the "yes" pathway (which means "it's your turn") leads to box #225. If the "no" pathway is used, see box #207 above.

At box #225 the player has a "yes/no" pathway to follow as to whether the player is on any ladder. If the answer is "no" player proceeds to box #226. If yes, see #230 below.

Box #226 represents the questionee spins for said card category and then proceeds to box #227.

At box #227 the questionee moves his gamepiece (FIG. 4, #75) to the respective space on the gameboard (FIG. 1, #28) which corresponds to the chance device (FIG. 2, #85) letter (FIG. 1, #1–#26) or number (FIG. 1, #30, #40, #50, and #60) and then proceeds to #228.

Box #228 represents "yes/no" as to whether the player has ladder access or not, i.e., landed on one of the numbered spaces. If "no" then player proceeds to box #229 where they answer the question and proceed to box #242 to wait until their next turn. If the answer is "yes", they have ladder access, and they proceed to box #243.

Box #243 represents that player correctly "yes/no" answer the question. If he/she answers incorrectly, then he proceeds to box #242 which is "wait until next turn". If answered correctly, then the player proceeds to box #244.

Box #244 represents that the player climb up the corresponding ladder one "Ignorance" rung and then proceed to box #242 to wait until the next turn.

Box #225 represents a "yes/no" decision which indicates whether it is said player's turn and that they are located on the ladder. They next proceed to box #230.

Box #230 a player is given an option "yes/no" to spin for a new card category. If the "yes" pathway is taken, (choosing to spin for a new card category) then player proceeds to box #231. If no, player goes to #235.

Box #231 represents that the player spin the chance device (FIG. 2, #85) and proceed to box #232.

Box #232 represents that the player determine and answer "yes/no" as to whether they answered the question correctly or not. The "yes" answer pathway leads to box #233. The "no" pathway leads to #234.

Box #233 represents that player go down one space. (If the player is on the any "Ignorance" rung of a ladder then they would move off the ladder down to the corner access ladder space). Refer to rule box #205 if necessary. From box #233 the plaer proceeds to said box #242.

Box #234 represents that the player move said gamepiece (FIG. 4, #75) up one rung on the ladder for a correct answer and proceed to box #238. Refer to rule box #205 if necessary. (In the event a player is on the "Excuse" rung of the ladder, he would move his gamepiece (FIG. 4, #75) to the Dean's/winner's circle (FIG. 1, #70).

At box #238 the player determines a "yes/no" pathway to follow if he/she is visiting said Dean's/winner's circle. When the player's determination is "no" he/she must proceed to box #242 by way of the "no" pathway to wait until the next turn. If the answer is "yes" the player proceeds to box #239.

At box #235 the player must answer a question category "yes/no" correctly which corresponds to the ladder access category he/she is on since he/she chose not to spin for a new chance question category. If the player answers the question incorrectly, he/she proceeds to box #236. If correctly answered, he proceeds to #237.

Box #236 represents that the player move back down one ladder rung and proceed to box #237. Refer to rule box #205 if necessary. (As previously stated, if they are on any said "Ignorance" rung, they move off the ladder onto the corner ladder access space).

Box #237 represents that the player move up one ladder rung (space) and proceed to box #238 "are you visiting the Dean's circle". When a player's response is "yes", he/she must proceed to box #239 by way of the "yes" pathway. Refer to rule box #205 if necessary.

At box #239 the player must determine "yes/no" if he/she will risk going down any ladder and continuing to play the game. If following the "no" pathway to #245, see #245 below.

If following the "yes" pathway, the daring player who chooses to keep playing the game then proceeds to box #240.

Box #240 represents that player choose a ladder pathway (any player reaching said Dean's/winner's circle and choosing to continue the game has the option of changing his/her ladder pathway before proceeding down again) which they choose to travel on and then proceed to box #241.

Box #241 represents that the player take two spaces down the ladder of their choice (as a rule bonus for taking the risk) and then proceed to box #242 to "wait till next turn".

At box #245 the player who is visiting the Dean chooses to win the game and the game is over and the respective player is the winner.

The scope of this invention is intended to include possible embodiments equivalent to this preferred embodiment. No unnecessary limitations are to be construed from our aforementioned preferred embodiment description. Many specificities are included in our aforementioned description and should not be construed as limitations on the scope of the invention, rather, the above description is intended to exemplify one particular preferred embodiment. Many other variations are possible. All embodiments are intended to include adaptation to computerized or electronic transmission means.

There may be adaptable arrangements of this invention, for example, players may choose to play with decks of cards which contain only categories of their particular individual interest, i.e., international law, juvenile law, etc.; the numbered categories could be transformed into three federal court districts each and one Supreme Court (with a transparency or peel-off stickers or any other temporary means) on the board to cover the corner categories which could be used to follow how the law has changed through historically controversial issues; lettered categories could be transformed in similar ways, for example, the letters could represent other Countries and their laws, from Australia to Zaire; arrangement of said legal subject matter may be altered for differing entertaining, teaching methods, for example, players may choose to limit the game to one category of legal subject matter offered in our game, that is, they may choose to play with decks of card containing a category only of treaties, or only of statutes, or only legal terminology, or only procedural law, and so on; players may choose instead of winning the game by reaching the Dean's/winner's circle, to accumulate points or credits (which may involve a scorecard) for correct answers, either an arbitrary number or the actual number required for graduation from a law school; players may, after reaching the Dean's/winner's circle and simulate receiving their J.D. choose to continue the game to simulate receiving their L.L.M.; the game may be adapted for players to "pass the bar" wherein subject areas would be selected from those actual areas required for admittance to an actual bar and bar categories substituted for the corner categories required for graduation by use of a transparency of peel-off stickers; adaptation may be further provided for player to practice as an attorney, for example, a card may contain a question from a client wherein player is required to select correct answer from card to advise client; another embodiment could alter said game so as the players could be adversaries wherein their opinions as to the way a case could go would be opposite, or as students simulating taking an exam wherein each may have opposite opinions wherein each can still be correct, or they can both take the same position and points would be accumulated on the basis of the correct amount of elements or issues the player can recognize in an analysis form of the game. In this manner, one player could play a judge while the other players would be competitors. The judge player would have access to a "judge's book" which would include information setting forth the elements of legal matter. For example, elements to prove murder, elements to prove a valid will, and elements for a multiplicity of various other legal matter. Thereby, the competing players would play with decks of cards whereby the elements of a respective specific legal matter would be involved and the players would be asked to recognize the legal issues involved, or legal elements that are requisite to the legal analysis. The judge would refer to his "judge's book" which would contain the elements or issues to the respective matter and points would be accumulated whereby the player with the most points would win the game.

Also, said game could be adapted to a prep game to help potential law students study for the LSAT (law school admissions test).

Additionally, in the preferred embodiment, a multiplicity of variations of law are combined. In an altered embodiment, players may choose to limit the scope of the game by playing only with a particularized portion, such as utilizing decks of cards dealing only with treaties, or, only with statutes, or legal terminology, or only procedural processes, or only laws of a particular Country. Additionally, hypothetical as well as real case situations may be included among questions.

In our preferred embodiment, we designed our ladder to have seven rungs to represent the seven words in the name of our game; however, in altering embodiments, the amount of rung/spaces may differ and thereby utilize more or less actual board space for playing purposes and this could be accomplished by eliminating the ladders and making the advancement toward the Dean's/winner's circle a spiral or dotted pathway with perhaps point spaces;

Since our preferred embodiment entails a fairly comprehensive arrangement, it is recognized that adaptation could be made to said embodiment whereby individual parts of our invention could be used in a manner such as to exclude from and thereby limit, or add to and thereby expand, the preferred embodiment without departing from the spirit thereof.

The scope of this invention should not be determined by the preferred embodiment, but rather, by the appended claims and their legal equivalents.

We claim:

1. A legal educational game apparatus to teach, test, entertain, allow chance, choice and competition and expose law comprising in combination:

a. a gameboard having a plurality of spaces located thereon, said plurality of spaces forming an outer playing path, a middle area and a plurality of inner playing paths that connect the outer playing path to the middle area, b. a first plurality of spaces in the outer playing path each containing indicia, c. a second plurality of spaces in the outer playing path each containing indicia, d. a third plurality of spaces in each of the inner playing paths each containing indicia, e. a fourth space representing the middle area and containing indicia, said first and second spaces comprising substantially all of the spaces located on said outer playing path, the indicia on each first and second space being different from the indicia on all other first and second spaces, f. a plurality of sets of cards, each card having identifying indicia thereon and each set being comprised of cards having the same identifying indicia thereon, the identifying indicia on the cards in one set being different from the identifying indicia on the cards in all other sets and the identifying indicia on the cards corresponding to the indicia on said first and second spaces, such that the indicia on each one of said first and second spaces corresponds to a different category of legal topics, the different categories of legal topics being represented by the various sets of cards, each of said cards also having response soliciting indicia thereon, whereby players attempt to give the correct response to the indicia presented on the cards, g. a rectangular card box designed for holding said plurality of sets of cards aligned next to one another in continuous rows, h. a chance means for each player at his respective turn to develop by chance or choice an identifying factor, i. player locating means in the form of moveable elements for indicating a player's location upon sad gameboard.

2. A game apparatus of claim 1 wherein:

a. said first plurality of spaces allow for access and advancement to said second plurality of spaces, b. said second plurality of spaces allow access and advancement to said third plurality of spaces, c. said third plurality of spaces allow players to advance forward, backward or remain stationary depending on the stage of the game, and wherein access and/or advancement to said third spaces is dependent upon chance, choice, risk, position and correct response by a player located on said second plurality of spaces, said third plurality of spaces allowing for access and advancement to said fourth space, d. said fourth space containing indicia differing from other said pluralities of spaces representing conclusion and simulation of graduating from law school, receiving an L.L.M. and/or passing the bar, or continuation of the game at the player's discretion, the latter option requiring subsequent access to said third plurality of spaces, whereby said fourth space designates a decision-making, competitive and risk aspect of game, access and advancement to said fourth space contingent upon chance and correct response and mandatory predefined game-rule prerequisites, e. wherein said categories of legal topics include legal processes, case law, over 205 fields of law, legal categories, individual state laws, federal law, international law, case precedents, legislative history, legal terminology, executive, judicial and/or legislative branches and/or processes, treaties, statutes, substantive and/or procedural law, comparative legal processes, legal aspects and variations of law contained therein and legal lexicon, f. wherein said chance means is used to determine a particular corresponding space on the game board to which a moveable element is to be moved or to choose a category of legal topics, or not be utilized at all depending upon which plurality of spaces the player is on.

3. A game apparatus of claim 1 wherein a. said response soliciting indicia comprises questions requiring answers, answers requiring questions, multiple choice, true/false, fill in the blank, name the missing element, matching, yes/no, finding an error in a statement of law, or identifying an issue of law, or a combination thereof, and wherein said categories of legal topics include legal knowledge encompassing, law, legal processes, case law, over 205 fields of law, legal categories, individual state laws, federal law, international law, case precedents, legislative history, legal terminology, executive, judicial and/or legislative branches and/or processes, treaties, statutes, substantive and/or procedural law, comparative legal processes, legal aspects and variations of law contained therein and legal lexicon.

4. A game apparatus of claim 1 wherein:

a. said chance means has indicia thereon corresponding to the indicia on said first and second, plurality of spaces on said game board and coinciding with the identifying indicia on said cards, whereby said chance means determines a particular space corresponding to said game board to place said moveable elements with respect to said first and second plurality of spaces or alternatively, said chance means is used to select a particular category of legal topic when a player is located on one of said third spaces.

* * * * *